United States Patent [19]

Newman

[11] Patent Number: 5,075,908

[45] Date of Patent: Dec. 31, 1991

[54] HAIR RINSE DEVICE

[76] Inventor: Valerie Y. Newman, 3680 Portland Rd., Portland, Mich. 48875

[21] Appl. No.: 650,227

[22] Filed: Feb. 4, 1991

[51] Int. Cl.[5] ..... A61H 33/00

[52] U.S. Cl. ..... 4/521; 4/516; 4/517; 4/518

[58] Field of Search ..... 4/515, 518, 519, 523

[56] References Cited

U.S. PATENT DOCUMENTS

| | | | |
|---|---|---|---|
| 998,803 | 7/1911 | Salisbury . | |
| 998,804 | 7/1911 | Salisbury . | |
| 2,856,918 | 10/1958 | Kingery et al. | 4/518 X |
| 3,292,186 | 12/1966 | Turmenne et al. | 4/519 |
| 3,587,577 | 6/1971 | Smirnov et al. | 4/518 |
| 3,732,580 | 5/1973 | Fava | 4/518 |
| 4,078,557 | 3/1978 | Spencer . | |
| 4,807,604 | 4/1989 | Canela . | |
| 4,817,218 | 4/1989 | Dimitriu et al. | 4/515 |
| 4,841,584 | 6/1989 | Overcash et al. . | |

FOREIGN PATENT DOCUMENTS

| | | | |
|---|---|---|---|
| 16875 | 9/1897 | United Kingdom | 4/518 |

*Primary Examiner*—Daniel M. Yasich

[57] ABSTRACT

A rinse bag is disclosed for rinsing the hair of a wearer. The rinse bag is relatively simple, inexpensive and is relatively compact, such that it does not require a great deal of space for use or storage. The rinse bag consists of a heavy bag having an elastic front which is sealingly received on the head of a wearer. A supply cup receives a pull-out water supply hose or tube, such as typically found on a sink in salons, to supply water into the interior of the bag. The supply cup is fluidly connected to a plurality of rinse tubes which extend axially within the bag, and which include a number of holes spaced axially along each individual rinse tube. Water is thus supplied evenly about the head of a wearer to thoroughly rinse the hair. With a rinse bag according to the present invention, it is ensured that the hair is thoroughly rinsed with a relatively inexpensive and simple device.

2 Claims, 1 Drawing Sheet

HAIR RINSE DEVICE

BACKGROUND OF THE INVENTION

This application generally relates to a device which assists in cleaning a wearer's hair. More particularly, this invention relates to a bag received over a wearer's head to ensure that water is evenly distributed to thoroughly clean the hair.

There has been a desire in the prior art to develop inventions which assist in cleaning, shampooing or rinsing hair. Such systems include devices which reduce leakage or spillage while the wearer's hair is being rinsed or cleaned. This is particularly important when rinsing permanent wave solutions from a wearer's head. There are certain restrictions on any such device. The devices must be relatively inexpensive and also must not require a large amount of space. Further, such devices are preferably relatively simple, such that they are reliable and do not require repair or maintenance.

There are known prior art devices for washing hair which are relatively complex. An example of such device is shown in the U.S. Pat. No. 3,603,320 in which a casing is received over a wearer's head. A plurality of treatment members clean the hair of the wearer.

A similar device is disclosed in U.S. Pat. No. 3,863,651. This patent discloses an automatic hair washing, conditioning and drying combination received over the head of a wearer. The device is relatively complicated.

A third machine is disclosed in U.S. Pat. No. 3,934,596. This patent discloses a shampooing apparatus which is relatively large in size. This device is overly complex, large and expensive.

U.S. Pat. No. 4,841,584 discloses a shampoo machine combined with a lounge chair. Again, this patented device is relatively complicated.

U.S. Pat. No. 4,078,557 discloses a hair washing device which includes a complicated helmet member. Relatively complicated controls are also used.

U.S. Pat. No. 4,807,604 discloses a scalp massaging device which includes a helmet connected to a water supply. Water is supplied to a single point within the helmet and sprayed upon the hair of the user.

U.S. Pat. Nos. 998,803 and 998,804 both disclose hair washing hoods. U.S. Pat. No. 998,804 discloses a plurality of spaced water supply ports. An inner liner is spaced from an outer liner and water is supplied to the space between the two. Ports are formed through the inner liner to supply water for cleaning the hair of a wearer.

The device disclosed in U.S. Pat. No. 998,804 may not adequately supply water to the entirety of a wearer's hair. When water is allowed to freely flow to a number of different areas, gravity influences that flow such that all areas of a wearer's hair may not be adequately supplied with water.

Each of these devices are somewhat undesirable in that they would not be connectable to the types of water supplies typically found in salon environments. Space is at a premium in most modern salons as are the available sinks. For this reason, the lack of adaptability of the above-discussed prior art devices to standard pull-out water supply tubes limit their practical usefulness.

It is an object of the present invention to disclose a relatively simple hair rinsing device which ensures water is evenly supplied to the wearer's hair. Further, it is an object of the present invention to disclose such a device which is relatively easy to use.

SUMMARY OF THE INVENTION

A disclosed rinse bag receives a water supply tube for supplying water into the bag at a first point. A plurality of rinse tubes are fluidly connected to the first point and extend within the bag towards a front of the bag. The rinse tubes each include a plurality of axially spaced openings which supply water to the head of the wearer. The plurality of openings in each of the rinse tubes ensure the wearer's entire head will be evenly and adequately cleaned.

In a preferred embodiment of the present invention, the rinse tubes openings are axially spaced and aligned. The openings are of a relatively small diameter such that the water within the rinse tubes passes along through the tube and only a portion of it escapes through any one opening. Thus, gravity does not pull the water out of the vertically lower tube openings, but instead the water flows to completely and evenly rinse the hair of a wearer.

In a preferred embodiment of the present invention, the rinse tubes have a outer surface attached with an adhesive to an inner surface of the bag. The rinse tubes further have an inner surface facing the user, with the openings being small apertures formed in the inner surface.

Further, a main feature of the present invention is that it is adaptable to the pull-out water supply tubes typically found in modern salons. In a preferred embodiment of the present invention, a cup receives the known single pull-out supply tube typically utilized and leads to a plurality of rinse tubes. Preferably, there are ten rinse tubes. Also, the rinse tubes are preferably oval in cross-section.

In a preferred embodiment of the present invention, the bag has an opening at a front surrounded by elastic to seal against the wearer's head. The rinse tubes extend from the first point, where the supply tube enters the bag, forwardly towards the elastic opening, and is connected by a front tube. Also, the rinse bag preferably has a drain opening at a vertically lowermost position to drain water from the bag.

A device according to the present invention achieves the goals of being relatively simple, inexpensive, and yet adequately and evenly supplies water to the entire head of a wearer. Such a device is particularly beneficial when used to rinse materials such as permanent wave solution from the hair of a wearer.

These and other objects and features of the present invention can be best understood from the following specification and drawings, of which the following is a brief description.

DETAILED DESCRIPTION OF THE PREFERRED EMBODIMENT

Figure 1:
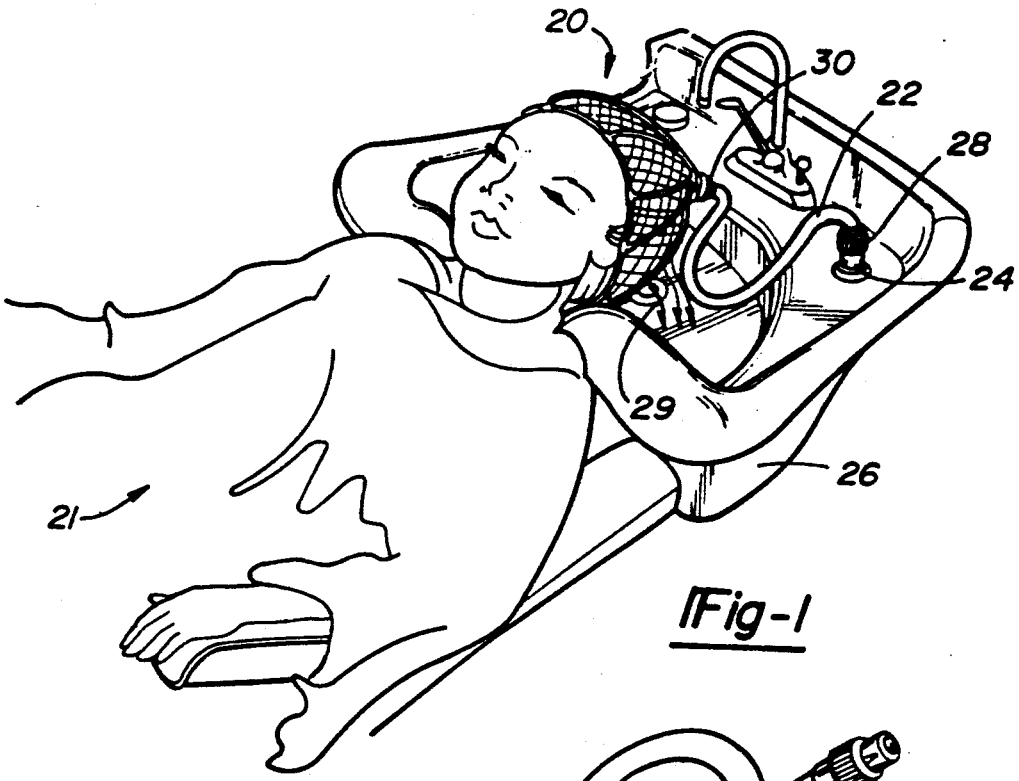
FIG. 1 is a perspective view of a hair rinse device according to the present invention.

FIG. 1 discloses rinse bag 20 worn to rinse the wearer's 21 hair. Rinse bag 20 may preferably be used to rinse any solutions from the hair of a wearer. As an example, it may be used to rinse permanent wave solution out of the wearer's hair.

Water supply hose or tube 22 is of the known pull-out type typically included in beauty salon sinks 36. Supply tube 22 is received in a cup member 28 on bag 20.

Drain opening 29 is formed in rinse bag 20 to drain water from the interior of the bag. Water is supplied through water supply tube 22, into cup 28, and into bag 20. The water is supplied to the head of wearer 21 and then drains out of drain opening 29 into sink 26.

Rinse bag 20 is a relatively simple device which is connected to the typical water supply tube 22 found in most beauty salons. As such, rinse bag 20 does not require any special equipment, is relatively inexpensive and requires a small amount of space for storage or use. For these reasons rinse bag 20 provides several benefits over the prior art systems.

Figure 2:
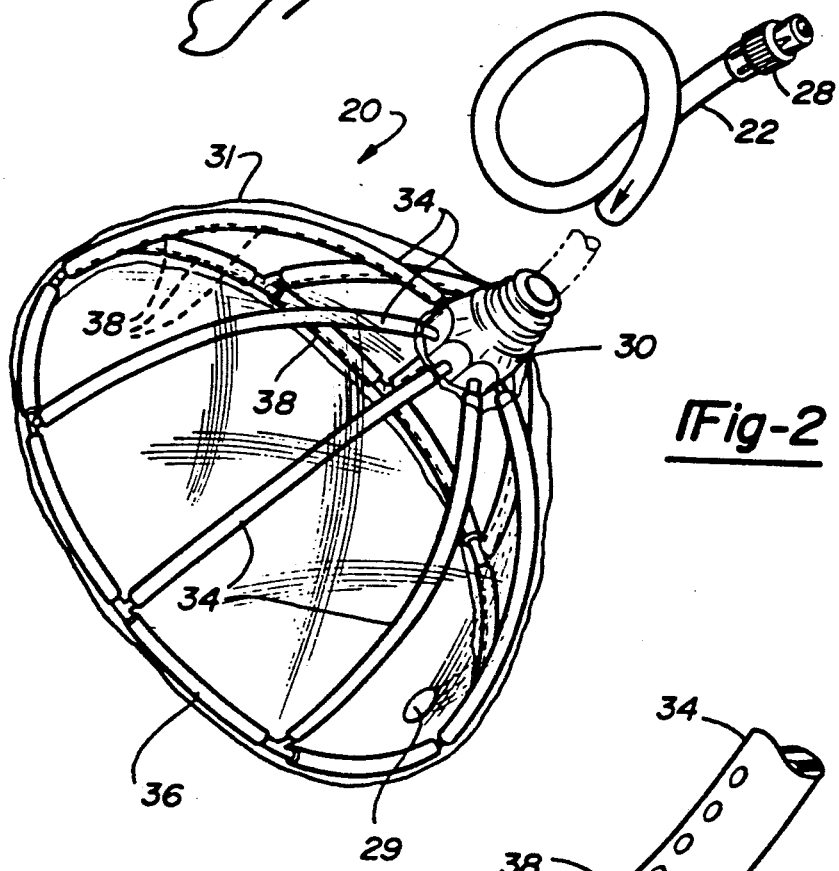
FIG. 2 is a perspective view of the hair rinse device shown in FIG. 1.

FIG. 2 illustrates rinse bag 20 including cup 28 to receive supply tube 22. Rinse bag 20 includes heavy outer bag 31, and cup 28 which receives water from single supply tube 22 and communicates that water to a plurality of rinse tubes 34 within outer bag 31. Rinse tubes 34 may be connected to cup 28 in any of several known ways. Cup 28 may also be of any type. The only restriction of the design is that cup 28 receive tube 22 and that the water be able to flow from supply tube 22 into rinse tubes 34. As an example, rinse tubes 34 may be plastic tubes which are connected to standard tube connections in cup 28.

As shown, supply tube 22 is pulled outwardly of the sink and inserted into cup 28, as shown in phantom at 40. It should be understood that cup 28 provides a adequate fluid seal to prevent leakage of water from supply tube 22.

Heavy bag 31 extends from cup 28 forwardly to a front opening surrounded by elastic material 37. Elastic material 37 ensures that bag 20 is securely received on the head of a wearer 21 and that water will not leak outwardly of rinse bag 20. Front ends of rinse tubes 34 are connected by a circular front tube 36. Rinse tubes 34 and 36 each have a plurality of supply holes 38 which communicate water to the head of wearer 21.

Rinse tubes 34 and 36 are preferably attached to interior of heavy bag 31 by some adhesive means. An outer face of rinse tubes 34 and 36 is connected to bag 31, while the inner face includes holes 38. In this way it is possible to ensure that rinse tubes 34 and 36 are properly positioned and spaced about bag 31. Alternatively, rinse tubes 34 and 36 may be simply secured to the elastic front 36 to control placement about bag 20.

The use of rinse bag 20 may now be fully understood. Water is supplied from supply tube 22 and into cup 28. Water flows into the plurality of rinse tubes 34, and outwardly through holes 38 onto the head of wearer 21. Since the holes are formed of a relatively small diameter, the water will tend to flow throughout the entire axial extent of rinse tubes 34, and will not simply exit through the vertically lower openings 38, or those which are most adjacent to cup 28. This ensures that water will be supplied evenly and adequately to the entirety of a wearer's head to thoroughly rinse the hair.

Drain opening 29 is shown at a vertically lowermost position of bag 20, such that water may be drained outwardly of the bag. Elastic front 36 ensures that the fluid flows through drain opening 29, rather than leaking outwardly of bag 20.

Figure 3:
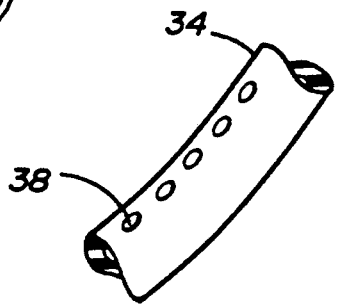
FIG. 3 is a enlarged view of a portion of a rinse tube according to the present invention.

FIG. 3 shows details of rinse tube 34 including openings or holes 38 extending through an inner face. Most preferably, rinse tubes 34 are oval in cross-section to produce optimum flow to thoroughly rinse the head of a wearer 21. Still more preferably, there are least ten rinse tubes 34 within the bag to ensure adequate rinsing of a wearer's hair.

A preferred embodiment of the present invention has been disclosed, however, a worker of ordinary skill in the art would realize that certain modifications would come within the scope of this invention and thus, the following claims should be studied in order to determine the true scope and content of the present invention.

I claim:

1. A rinse bag comprising:

a flexible plastic bag to be received on a wearer's head;

supply means for supplying fluid into said bag at a first point, said supply means being a cup for receiving a pull-out water supply tube;

said bag defining a front opening surrounded by elastic to seal on a wearer's head;

a plurality of rinse tubes fluidly connected to said supply means and extending within said bag from said first point axially towards said front opening;

said bag having a drain opening at a vertically lowermost position for draining water from said bag;

said rinse tubes each including a plurality of openings to supply fluid from said supply means to the head of a wearer;

said openings in said rinse tubes are axially spaced and aligned holes extending through said rinse tubes; and said rinse tubes being attached to said bag, and having an outer surface facing said bag and an inner surface facing a wearer, said openings being formed in said inner surface.

2. A rinse bag as recited in claim 1, wherein there are ten of said rinse tubes.

* * * * *